US005244565A

United States Patent [19]

Lankton et al.

[11] Patent Number: 5,244,565

[45] Date of Patent: Sep. 14, 1993

[54] INTEGRATED PROCESS FOR THE PRODUCTION OF DISTILLATE HYDROCARBON

[75] Inventors: Steven P. Lankton, Wheeling; Tom N. Kalnes, La Grange; Robert B. James, Jr., Northbrook, all of Ill.

[73] Assignee: UOP, Des Plaines, Ill.

[21] Appl. No.: 813,522

[22] Filed: Dec. 26, 1991

Related U.S. Application Data

[63] Continuation-in-part of Ser. No. 568,929, Aug. 17, 1990, abandoned.

[51] Int. Cl.[5] ..... C10G 37/00

[52] U.S. Cl. ..... 208/92; 208/86; 208/94; 208/100; 208/143; 208/113; 208/179; 208/78; 208/57; 208/49; 208/251 R

[58] Field of Search ..... 208/86, 92, 94, 100, 208/143, 251 R, 49, 57, 78, 113

[56] References Cited

U.S. PATENT DOCUMENTS 3,671,419 6/1972 Ireland et al. ..... 208/57
4,310,409 1/1982 Wernicke et al. ..... 208/57
4,528,100 7/1985 Zarchy ..... 210/634
4,818,368 4/1989 Kalnes et al. ..... 208/50
4,882,037 11/1989 Kalnes et al. ..... 208/85

*Primary Examiner*—Helane Myers
*Attorney, Agent, or Firm*—Thomas K. McBride; John G. Tolomei; John G. Cutts, Jr.

[57] ABSTRACT

A process for the production of distillate hydrocarbon from atmospheric fractionation residue and waste lubricants by means of contacting the waste lubricant with a hot hydrogen-rich gaseous stream to increase the temperature of this feed stream to vaporize at least a portion of the distillable hydrocarbonaceous compounds thereby producing a distillable hydrocarbonaceous stream which is immediately hydrogenated in an integrated hydrogenation zone. The vaporization of the waste oil is also conducted in the presence of a vacuum fractionation residue which is produced in the integrated process. The resulting effluent from the integrated hydrogenation zone and a distillable hydrocarbon stream recovered from the atmospheric fraction residue is catalytically converted to produce lower molecular weight hydrocarbon compounds.

14 Claims, 1 Drawing Sheet

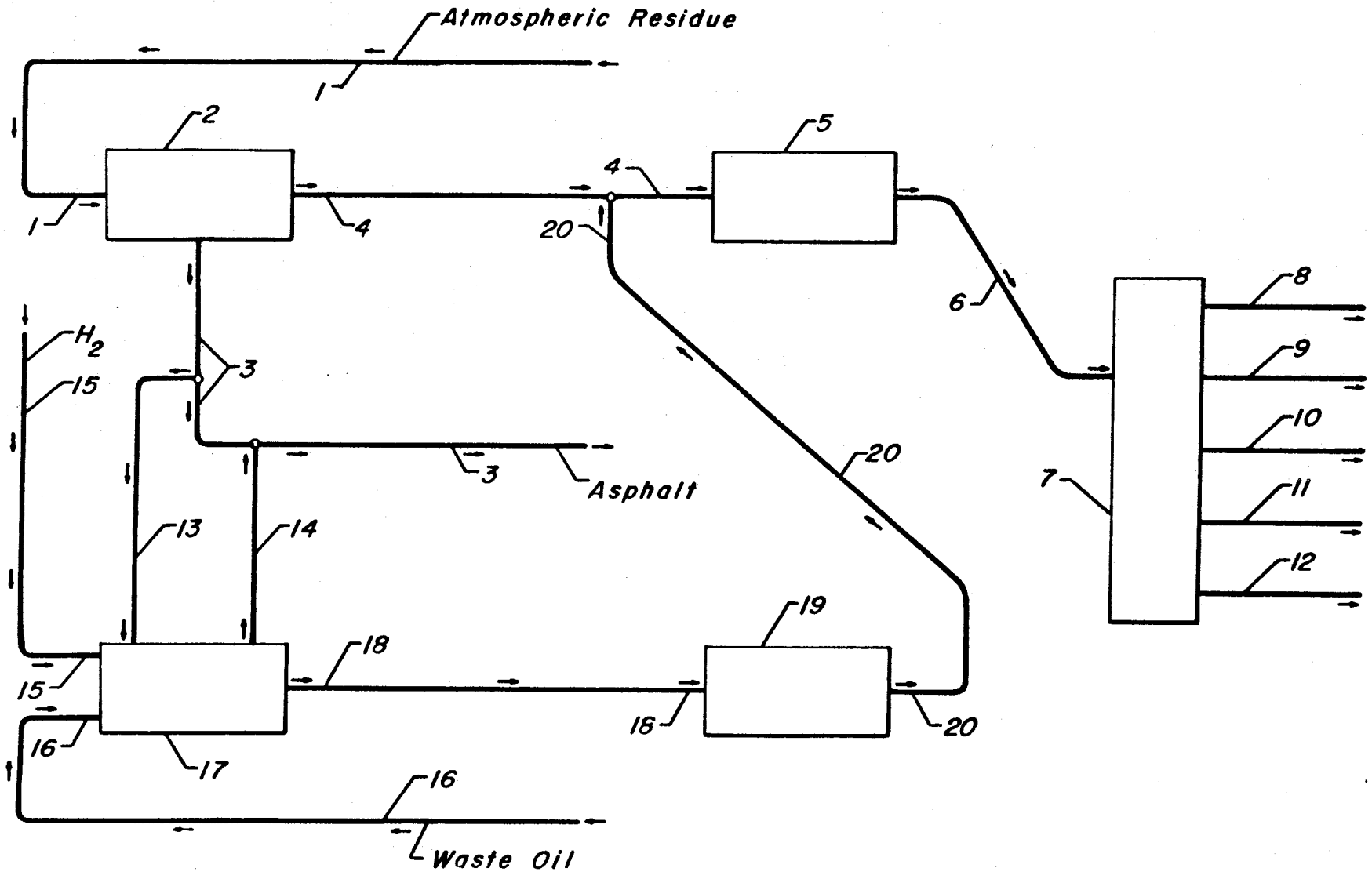
Atmospheric Residue
Asphalt
Waste Oil
$H_2$
1
2
3
4
5
6
7
8
9
10
11
12
13
14
15
16
17
18
19
20

INTEGRATED PROCESS FOR THE PRODUCTION OF DISTILLATE HYDROCARBON

CROSS-REFERENCE TO RELATED APPLICATION

This application is a continuation-in-part of application Ser. No. 07/568,929 filed Aug. 17, 1990 now abandoned, all the teachings of which are incorporated by reference.

BACKGROUND OF THE INVENTION

The field of art to which this invention pertains is the production of distillate hydrocarbon from atmospheric fractionation residue and waste lubricant.

There has always been a demand for high quality distillate hydrocarbon and recently there is a steadily increasing demand for technology which is capable of reclaiming and rerefining of waste lubricants. Previous techniques utilized to dispose of waste lubricants which are frequently contaminated with halogenated organic compounds and other heteroatomic compounds have frequently become environmentally unpopular or illegal and, in general, have always been expensive. With the increased environmental emphasis for the treatment and recycle of chlorinated organic compounds and waste lubricants, there is an increased need for the conversion of these products when they become spent and unwanted. For example, large quantities of used motor oil are generated and discarded which oil would provide a large potential supply of feedstock for the present invention while providing an environmentally responsible disposal. Therefore, those skilled in the art have sought to find feasible techniques to convert such feedstocks to provide hydrocarbonaceous product streams which may be safely and usefully employed or recycled. Previous techniques which have been employed include incineration and dumping which, in addition to potential pollution considerations, fail to recover valuable hydrocarbonaceous materials.

INFORMATION DISCLOSURE

In U.S. Pat. No. 3,133,013 (Watkins), a process is disclosed which relates to the hydrorefining of hydrocarbons for the purpose of removing diverse contaminants therefrom and/or reacting such hydrocarbons to improve the chemical and physical characteristics thereof. In addition, the process is directed toward the selective hydrogenation of unsaturated, coke-forming hydrocarbons through the use of particular conditions whereby the formation of coke, otherwise resulting from the hydrorefining of such hydrocarbon fractions and distillates, is effectively inhibited.

In U.S. Pat. No. 3,992,285 (Hutchings), a process is disclosed for the desulfurization of a hydrocarbonaceous black oil containing sulfur and asphaltic material which comprises preheating the oil by indirect heat exchange to a temperature not in excess of about 550° F., commingling the preheated oil with a steam-containing gas to raise the temperature of the oil to a desulfurization temperature of about 600° F. to about 800° F. and contacting the thus-heated oil at hydrocarbon conversion conditions with a desulfurization catalyst.

In U.S. Pat. No. 4,882,037 (Kalnes et al), a process is disclosed for treating a temperature-sensitive hydrocarbonaceous stream containing a non-distillable component and a distillable, hydrogenatable hydrocarbonaceous fraction to produce a selected hydrogenated distillable light hydrocarbonaceous product, a distillable heavy hydrocarbonaceous liquid product and a heavy product.

U.S. Pat. No. 3,671,419 (Ireland et al) discloses a petroleum refinery operation by a specific combination of unit operations which optimize premium products. A significant feature of this combination is the catalytic hydrogenation of a fraction boiling above the gasoline range up to 1100° F., followed by cutting or separating the hydrogenated product to form a high boiling fraction boiling above about 700° F. as a charge stock to a crystalline aluminosilicate catalytic cracking operation with the low boiling fraction thereof boiling below about 700° F. being charged to catalytic hydrocracking. The '419 patent does not disclose or suggest the integrated process for the production of distillate hydrocarbon from atmospheric fractionation residue and waste lubricant as taught by the present invention.

U.S. Pat. No. 4,310,409 (Wernicke et al), a process is disclosed to produce ethylene in a thermal cracking step whereby a preferred feed of distillate and deasphalted fractions is hydrogenated and separated into a light fraction and a heavy fraction, and only the heavy fraction is charged to the thermal cracking stage. The '409 patent does not disclose or suggest the integrated process for the production of distillate hydrocarbon from atmospheric fractionation residue and waste lubricant as taught by the present invention.

In U.S. Pat. No. 4,818,386 (Kalnes et al), a process is disclosed for treating a temperature-sensitive hydrocarbonaceous stream containing a non-distillable component to produce a hydrogenated distillable hydrocarbonaceous product while minimizing thermal degradation of the hydrocarbonaceous stream. The '368 patent fails to teach an integrated process for the production of distillate hydrocarbon from atmospheric fractionation residue and waste lubricant.

In U.S. Pat. No. 4,528,100 (Zarchy), a process is disclosed for the treatment of residual oil to recover or isolate metal values which are indigenous to the residual oil by employing supercritical solvent extraction of the residual oil. The '100 patent does not teach the integrated process for the production of distillate hydrocarbon from atmospheric fractionation residue and waste lubricant as taught by the present invention.

BRIEF SUMMARY OF THE INVENTION

The invention provides an integrated process for the production of distillate hydrocarbon from atmospheric fractionation residue and waste lubricants by means of contacting the waste lubricant with a hot hydrogen-rich gaseous stream to increase the temperature of this feed stream to vaporize at least a portion of the distillable hydrocarbonaceous compounds thereby producing a distillable hydrocarbonaceous stream which is immediately hydrogenated in an integrated hydrogenation zone. The vaporization of the waste oil is also conducted in the presence of a vacuum fractionation residue which is produced in the integrated process of the present invention. The resulting effluent from the integrated hydrogenation zone is separated to provide a distillable hydrocarbon stream which is converted in a hydrocarbon conversion zone to produce lower molecular weight hydrocarbon compounds. An atmospheric residue is introduced into a vacuum fractionation zone to provide a distillable hydrocarbon stream and a vacuum fractionation residue. The distillate hydrocarbon stream recovered from the vacuum fractionation zone is then combined with the distillate hydrocarbon stream recovered from the hydrogenation reaction zone and the resulting admixture is introduced into a hydrocarbon conversion zone containing hydrocarbon conversion catalyst to produce lower molecular weight hydrocarbon compounds. Important elements of the improved process are the relatively short time that the waste oil stream is maintained at elevated temperature, the avoidance of heating the waste oil stream via indirect heat exchange to preclude the coke formation that would otherwise occur, the use of a vacuum fractionation residue stream to provide at least a portion of the heat required to vaporize the waste oil and to provide a carrier material to sweep the flash zone of non-distillable components which are indigenous to the waste oil feed stream, the recovery of a demetallized, high-hydrogen content, low sulfur, low-wax content conversion unit feedstock from the waste lubricant, the ability to simultaneously recover and utilize various streams of high quality distillable hydrocarbonaceous compounds, the immobilization of the inorganic portion of the waste lubricant in an asphalt product component, and the minimization of utility costs due to the integration of the hot flash separation zone, the hydrogenation zone and the vacuum fractionation zone.

One embodiment of the invention may be characterized as an integrated process for the production of distillate hydrocarbon from atmospheric fractionation residue and waste lubricant which process comprises: (a) fractionating the atmospheric fractionation residue in a vacuum fractionation zone to provide a first distillable hydrocarbon stream and a vacuum fractionation residue; (b) contacting the waste lubricant and at least a fraction of the vacuum fractionation residue with a hot first hydrogen-rich gaseous stream in a flash zone at flash conditions thereby increasing the temperature of the waste lubricant to provide a hydrocarbonaceous vapor stream comprising hydrogen and a non-distillable component containing asphalt; (c) contacting the hydrocarbonaceous vapor stream comprising hydrogen with a hydrogenation catalyst in a hydrogenation reaction zone at hydrogenation conditions to increase the hydrogen content of the hydrocarbonaceous compounds; (d) condensing at least a portion of the resulting effluent from the hydrogenation reaction zone to provide a second hydrogen-rich gaseous stream and a liquid stream comprising hydrogenated distillable hydrocarbonaceous compounds; (e) contacting at least a portion of the first distillable hydrocarbon stream recovered in step (a) and at least a fraction of the liquid stream comprising hydrogenated hydrocarbonaceous compounds recovered in step (d) with a hydrocarbon conversion catalyst in a hydrocarbon conversion zone to produce lower molecular weight hydrocarbon compounds; and (f) recovering at least one distillate hydrocarbon product stream from the effluent from the hydrocarbon conversion zone.

Another embodiment of the invention may be characterized as an integrated process for the production of distillate hydrocarbon from atmospheric fraction residue and waste lubricant which process comprises: (a) fractionating the atmospheric fraction residue in a vacuum fractionation zone to provide a first distillable hydrocarbon stream and a vacuum fractionation residue; (b) contacting the waste lubricant and at least a fraction of the vacuum fractionation residue with a hot first hydrogen-rich gaseous stream in a flash zone at flash conditions thereby increasing the temperature of the waste lubricant to provide a hydrocarbonaceous vapor stream comprising hydrogen and a non-distillable component containing asphalt; (c) contacting the hydrocarbonaceous vapor stream comprising hydrogen with a hydrogenation catalyst in a hydrogenation reaction zone at hydrogenation conditions to increase the hydrogen content of the hydrocarbonaceous compounds; (d) condensing at least a portion of the resulting effluent from the hydrogenation reaction zone to provide a second hydrogen-rich gaseous stream and a liquid stream comprising hydrogenated distillable hydrocarbonaceous compounds; (e) contacting at least a portion of the first distillable hydrocarbon stream recovered in step (a) and at least a fraction of the liquid stream comprising hydrogenated distillable hydrocarbonaceous compounds recovered in step (d) with a hydrocarbon conversion catalyst in a hydrocarbon conversion zone to produce lower molecular weight hydrocarbon compounds; (f) recovering at least one distillate hydrocarbon product stream from the effluent from the hydrocarbon conversion zone; and (g) recovering at least a portion of the vacuum fractionation residue and the non-distillable component containing asphalt.

Other embodiments of the present invention encompass further details such as preferred feedstocks, hydrogenation catalysts, hydrocarbon conversion catalysts and operating conditions, all of which are hereinafter disclosed in the following discussion of each of these facets of the invention.

BRIEF DESCRIPTION OF THE DRAWING

The drawing is a simplified process flow diagram of a preferred embodiment of the present invention.

DETAILED DESCRIPTION OF THE INVENTION

The present invention provides an improved integrated process for the production of distillate hydrocarbon from atmospheric fractionation residue and waste lubricant.

A wide variety of atmospheric residue and waste lubricant are to be candidates for feedstock in accordance with the process of the present invention. Examples of such waste lubricant which are suitable for treatment by the process of the present invention are hydraulic fluids, heat transfer fluids, used lubricating oil, used cutting oils and used solvents. The atmospheric residue feed to the present application may be conveniently prepared by topping or the atmospheric fractionation of a crude oil which is suitable for the production of various distillate hydrocarbon streams. Many of the waste lubricant streams which are suitable for the present invention may contain non-distillable components which include, for example, organometallic compounds, inorganic metallic compounds, finely divided particulate matter and non-distillable hydrocarbonaceous compounds. The present invention is particularly advantageous when the non-distillable components comprise sub-micron particulate matter and the conventional techniques of filtration, centrifugation or distillation tend to be highly ineffective.

The presence of a non-distillable component including finely divided particulate matter in a waste lubricant feed to a hydrogenation zone greatly increases the difficulty of hydrogenation. A non-distillable component tends 1) to foul the hot heat-exchange surfaces which are used to heat the feed to hydrogenation conditions; 2)

to form coke or in some other manner, deactivate the hydrogenation catalyst thereby shortening its active life; and 3) to otherwise hinder a smooth and facile hydrogenation operation. Particulate matter in a feed stream tends to deposit within the hydrogenation zone and to plug a fixed hydrogenation catalyst bed thereby abbreviating the time on stream.

Once the waste lubricant stream containing a non-distillable component is separated into a distillable hydrocarbonaceous stream and a heavy non-distillable product, the resulting distillable hydrocarbonaceous stream is introduced into a hydrogenation zone. If the feed stream contains metallic compounds such as those that contain metals such as zinc, copper, iron, barium, phosphorus, magnesium, aluminum, lead, mercury, cadmium, cobalt, arsenic, vanadium, chromium, and nickel, these compounds will be isolated in the relatively small volume of recovered non-distillable product which may then be immobilized in an asphalt matrix, treated for metals recovery or otherwise disposed of as desired. In the event that the waste lubricant stream contains distillable hydrocarbonaceous compounds which include sulfur, oxygen, nitrogen, metal or halogen components, the resulting recovered distillable hydrocarbonaceous stream is hydrogenated to remove or convert such components as desired. In the present invention, the hydrogenation of the resulting distillable hydrocarbonaceous stream is conducted immediately without intermediate separation or condensation. The advantages of the integrated process of the present invention will be readily apparent to those skilled in the art and include the economy of greatly reduced utility costs.

In accordance with the present invention, a waste lubricant stream is contacted with a hot hydrogen-rich gaseous stream having a temperature greater than the waste lubricant stream in a flash zone at flash conditions thereby increasing the temperature of the waste lubricant stream and vaporizing at least a portion thereof to provide a hydrocarbonaceous vapor stream comprising hydrogen and a heavy non-distillable product. Simultaneously, a fraction of vacuum fractionation residue stream is introduced into the flash zone in order to supply at least a portion of the heat required to vaporize the incoming waste lubricant stream and to flush the heavy non-distillable material from the bottom of the flash zone. In a preferred embodiment, the vacuum fractionation residue stream is introduced in an amount from about 1 to about 150 volume percent of the waste lubricant feed stream. In one embodiment of the present invention, the vacuum fractionation residue stream may be solvent deasphalted to recover a deasphalted oil stream before the vacuum fractionation residue stream is introduced into the flash zone. This resulting flash zone bottom stream may then be recovered and utilized in conjunction with any other remaining asphalt residue which is generated during the fractionation of atmospheric fractionator residue to produce the vacuum column bottoms stream or during any solvent deasphalting. The hot hydrogen-rich gaseous stream preferably comprises more than about 70 mol percent hydrogen and preferably more than about 90 mol percent hydrogen. In a preferred embodiment, the hot hydrogen-rich gaseous stream is comprised of a recycle hydrogen gas stream which is recovered downstream of the hydrogenation reaction zone. The hot hydrogen-rich gaseous stream is multi-functional and serves as 1) a heat source used to directly heat the waste lubricant stream to preclude the coke formation that could otherwise occur when using an indirect heating apparatus such as a heater or heat-exchanger; 2) a diluent to reduce the partial pressure of the hydrocarbonaceous compounds during vaporization in the flash zone; 3) a possible reactant to minimize the formation of hydrocarbonaceous polymers at elevated temperatures; 4) a stripping medium; and 5) at least a portion of the hydrogen required in the hydrogenation reaction zone. In accordance with the present invention the waste lubricant stream containing a non-distillable component is preferably maintained at a temperature less than about 482° F. (250° C.) before being introduced into the flash zone in order to prevent or minimize the thermal degradation of the feed stream. Depending upon the characteristics and composition of the waste lubricant stream, the hot hydrogen-rich gaseous stream is introduced into the flash zone at a temperature greater than the waste lubricant stream and preferably at a temperature from about 200° F. (93° C.) to about 1200° F. (649° C.).

In addition, the vacuum fractionation residue stream, also referred to herein as vacuum column bottoms, or a fraction of the vacuum column bottoms, is introduced into the hot flash separator at a temperature from about 300° F. (149° C.) to about 900° F. (482° C.) and in an amount from about 0.5 to about 150 volume percent based upon the waste lubricant feed stream.

The flash zone is preferably maintained at flash conditions which include a temperature from about 150° F. (65° C.) to about 860° F. (460° C.), a pressure from about atmospheric to about 2000 psig (13788 kPa gauge), a hydrogen circulation rate of about 1000 SCFB (168 normal $m^3/m^3$) to about 60,000 SCFB (10,110 normal $m^3/m^3$) based on the waste lubricant feed stream to the flash zone and an average residence time of the hydrogen-containing, hydrocarbonaceous vapor stream in the flash zone from about 0.1 seconds to about 50 seconds. A more preferred average residence time of the hydrogen-containing hydrocarbonaceous vapor stream in the flash zone is from about 1 second to about 10 seconds.

The resulting heavy non-distillable portion of the waste lubricant stream and the asphalt residue which is also introduced into the hot flash separator are removed from the bottom of the flash zone as required to yield a heavy non-distillable asphalt product stream. The heavy non-distillable asphalt product may contain a relatively small amount of distillable component, but since essentially all of the non-distillable components contained in the waste lubricant feed stream are recovered in this product stream, the term "heavy non-distillable asphalt product" is nevertheless used for the convenient description of this product stream. The heavy non-distillable asphalt product preferably contains a distillable component of less than about 10 wt. % and more preferably less than about 5 wt. %. When the non-distillable fraction is flushed with asphalt residue, the properties of the asphalt residue are enhanced for use as an asphalt cement and thus provides a useful outlet for the bottoms. In addition, toxic metals are stabilized and made non-leachable. In one embodiment, the metal values may be recovered from the asphalt residue and the non-distillable component containing asphalt.

The resulting hydrogen-containing hydrocarbonaceous vapor stream is removed from the flash zone and is introduced into a catalytic hydrogenation zone containing hydrogenation catalyst and maintained at hydrogenation conditions. The catalytic hydrogenation zone may contain a fixed, ebullated or fluidized catalyst bed. This reaction zone is preferably maintained under an imposed pressure from about atmospheric (0 kPa gauge) to about 2000 psig (13,790 kPa gauge) and more preferably under a pressure from about 100 psig (689.5 kPa gauge) to about 1800 psig (12,411 kPa gauge). Suitably, such reaction is conducted with a maximum catalyst bed temperature in the range of about 122° F. (50° C.) to about 850° F. (454° C.) selected to perform the desired hydrogenation conversion and reduce or eliminate the undesirable characteristics or components of the hydrocarbonaceous vapor stream. In accordance with the present invention, it is contemplated that the desired hydrogenation conversion includes, for example, dehalogenation, desulfurization, denitrification, olefin saturation, oxygenate conversion and hydrocracking. Further preferred operating conditions include liquid hourly space velocities in the range from about 0.05 $hr.^{-1}$ to about 20 $hr.^{-1}$ and hydrogen circulation rates from about 200 standard cubic feet per barrel (SCFB) (33.71 normal $m^3/m^3$) to about 70,000 SCFB (11,796 normal $m^3/m^3$), preferably from about 300 SCFB (50.6 normal $m^3/m^3$) to about 20,000 SCFB (3371 normal $m^3/m^3$).

In the event that the temperature of the hydrogen-containing hydrocarbonaceous stream which is removed from the flash zone is not deemed to be exactly the temperature selected to operate the catalytic hydrogenation zone, we contemplate that the temperature of the hydrogen-containing, hydrocarbonaceous stream may be adjusted either upward or downward in order to achieve the desired temperature in the catalytic hydrogenation zone. Such a temperature adjustment may be accomplished, for example, by the addition of either cold or hot hydrogen.

The preferred catalytic composite disposed within the hereinabove-described hydrogenation zone can be characterized as containing a metallic component having hydrogenation activity, which component is combined with a suitable refractory inorganic oxide carrier material of either synthetic or natural origin. The precise composition and method of manufacturing the carrier material are not considered essential to the present invention. Preferred carrier materials are alumina, silica and mixtures thereof. Suitable metallic components having hydrogenation activity are those selected from the group comprising the metals of Groups VI-B and VIII of the Periodic Table, as set forth in the *Periodic Table of the Elements*, E. H. Sargent and Company, 1964. Thus, the catalytic composites may comprise one or more metallic components from the group of molybdenum, tungsten, chromium, iron, cobalt, nickel, platinum, palladium, iridium, osmium, rhodium, ruthenium, and mixtures thereof. The concentration of the catalytically active metallic component, or components, is primarily dependent upon a particular metal as well as the physical and/or chemical characteristics of the particular hydrocarbon feedstock. For example, the metallic components of Group VI-B are generally present in an amount within the range of from about 1 to about 20 weight percent, the iron-group metals in an amount within the range of about 0.2 to about 10 weight percent, whereas the noble metals of Group VIII are preferably present in an amount within the range of from about 0.1 to about 5 weight percent, all of which are calculated as if these components existed within the catalytic composite in the elemental state. In addition, any catalyst employed commercially for hydrogenating middle distillate hydrocarbonaceous compounds to remove nitrogen and sulfur may function effectively in the hydrogenation zone of the present invention. It is further contemplated that hydrogenation catalytic composites may comprise one or more of the following components: cesium, francium, lithium, potassium, rubidium, sodium, copper, gold, silver, cadmium, mercury and zinc.

The hydrocarbonaceous effluent from the hydrogenation zone is preferably partially condensed in a hot separator. The resulting vapor phase is then contacted with an aqueous scrubbing solution and the admixture is admitted to a separation zone in order to separate a spent aqueous stream, a hydrogenated hydrocarbonaceous liquid phase and a hydrogen-rich gaseous phase. The contact of the hydrocarbonaceous effluent from the hydrogenation zone with the aqueous scrubbing solution may be performed in any convenient manner and is preferably conducted by co-current, in-line mixing which may be promoted by inherent turbulence, mixing orifices or any other suitable mixing means. The aqueous scrubbing solution is preferably introduced in an amount from about 1 to about 100 volume percent based on the hydrocarbonaceous effluent from the hydrogenation zone. The aqueous scrubbing solution is selected depending on the characteristics of the hydrocarbonaceous vapor stream introduced into the hydrogenation zone. For example, if the hydrocarbonaceous vapor stream to the hydrogenation zone comprises halogenated compounds, the aqueous scrubbing solution preferably contains a basic compound such as calcium hydroxide, potassium hydroxide, potassium carbonate, sodium carbonate or sodium hydroxide in order to neutralize the acid such as hydrogen chloride, hydrogen bromide and hydrogen fluoride, for example, which is formed during the hydrogenation of the halogen compounds. In the event that the hydrocarbonaceous vapor stream contains only sulfur and nitrogen compounds, water may be a suitable aqueous scrubbing solution to dissolve the resulting hydrogen sulfide and ammonia. The resulting hydrogenated hydrocarbonaceous liquid phase is recovered and the hydrogen-rich gaseous phase may be recycled to the hydrogenation zone and/or to the flash zone if desired.

The resulting hydrogenated hydrocarbonaceous liquid phase is preferably recovered from the hydrogen-rich gaseous phase in a separation zone which is maintained at essentially the same pressure as the hydrogenation reaction zone and as a consequence contains dissolved hydrogen and low molecular weight normally gaseous hydrocarbons if present. In accordance with the present invention, it is preferred that the hydrogenated hydrocarbonaceous liquid phase comprising the hereinabove mentioned gases be stabilized in a convenient manner, such as, for example, by stripping or flashing to remove the normally gaseous components to provide a stable hydrogenated distillable hydrocarbonaceous stream which is then used to provide a portion of the feed to the hydrocarbon conversion zone to produce lower molecular weight hydrocarbon compounds.

In accordance with the present invention, the atmospheric residue is prepared by fractionating a whole crude oil in a crude fractionation column or tower. Generally, the atmospheric residue is the bottoms stream from the crude fractionation column. The atmospheric residue is introduced into a vacuum unit or a vacuum fractionation column to produce vacuum gas oil and a heavy non-distillable fraction containing asphalt which is often referred to as vacuum column bottoms or vacuum fractionation residue. The hereinabove fractionations are well known to those skilled in the petroleum refining art. A portion of the vacuum fractionation residue stream or a fraction of the vacuum fractionation residue is introduced into the hot hydrogen flash zone as described hereinabove.

The vacuum gas oil and at least a portion of the hydrogenated distillable hydrocarbonaceous stream are then introduced into a hydrocarbon conversion zone to produce lower molecular weight hydrocarbon compounds. In accordance with the present invention, the hydrocarbon conversion zone may be selected from the group consisting of a fluid catalytic cracker (FCC) and a hydrocracking process. Those skilled in the art of petroleum refining will readily be able to design and operate such hydrocarbon conversion processes.

DETAILED DESCRIPTION OF THE DRAWING

In the drawing, the process of the present invention is illustrated by means of a simplified flow diagram in which such details as the total number of reaction zone vessels, pumps, instrumentation, heat exchange and heat-recovery circuits, compressors and similar hardware have been deleted as being non-essential to an understanding of the techniques involved. The use of such miscellaneous appurtenances are well within the purview of one skilled in the art.

With reference now to the drawing, an atmospheric residue feed stream having an asphalt component is introduced into the process via conduit 1 and is fractionated in vacuum unit 2. A resulting vacuum gas oil stream is removed from vacuum unit 2 via conduit 4 and introduced into catalytic conversion zone 5. A vacuum fractionation residue stream is removed from vacuum unit 2 via conduit 3 and at least a portion of the vacuum fractionation residue stream is furthermore recovered from the process via conduit 3. A waste oil feed stream is introduced into the process via conduit 16 and is contacted with a hot gaseous hydrogen-rich stream which is provided via conduit 15 and the waste oil is flashed in feed separation zone 17. At least a portion of the vacuum fractionation residue which is removed from vacuum unit 2 via conduit 3 is introduced into feed separation zone 17 via conduit 13. A hydrocarbonaceous vapor stream comprising hydrogen is removed from feed separation zone 17 via conduit 18 and introduced into hydrogenation reaction zone 19 without intermediate separation thereof. A heavy non-distillable stream is removed from feed separation zone 17 via conduits 14 and 3 and recovered. A stream containing hydrogenated distillable hydrocarbonaceous compounds is removed from hydrogenation reaction zone 19 via conduit 20 and introduced into catalytic conversion zone 5 via conduits 20 and 4. Since hydrogen is lost in the process by means of a portion of the hydrogen being consumed during the hydrogenation reaction, it is necessary to supplement the hydrogen-rich gaseous stream with make-up hydrogen from some suitable external source, for example, a catalytic reforming unit or a hydrogen plant. Make-up hydrogen may be introduced into the system at any convenient and suitable point, and is introduced in the drawing via conduit 15. At least a portion of the hydrogen introduced via conduit 15 is recovered and recycled from hydrogenation reaction zone 19. Converted hydrocarbons generally having a lower molecular weight are removed from catalytic conversion zone 5 via conduit 6 and introduced into separation zone 7. Hydrocarbon product streams are recovered from separation zone 7 via conduits 8, 9, 10, 11 and 12.

The process of the present invention is further demonstrated by the following illustrative embodiment. This illustrative embodiment is, however, not presented to unduly limit the process of this invention, but to further illustrate the advantages of the hereinabove-described embodiments. The following data were not completely obtained by the actual performance of the present invention, but are considered prospective and reasonably illustrative of the expected performance of the invention.

ILLUSTRATIVE EMBODIMENT

A waste lube oil having the characteristics presented in Table 1 and contaminated with 20 ppm by weight of polychlorinated biphenyl (PCB) is charged at a rate of 100 mass units per hour to a hot hydrogen flash separation zone. The hot hydrogen is introduced into the hot hydrogen flash separation zone at a rate of 31 mass units per hour. A stream of asphalt residue in an amount of 135 mass units and having a temperature of 700° F. (370° C.) is also introduced into the hot hydrogen flash separation zone.

TABLE 1

WASTE LUBE OIL FEEDSTOCK PROPERTIES

| | | |
|---|---|---|
| Specific Gravity @ 60° F. (15° C.) | | 0.8827 |
| Vacuum Distillation Boiling Range, (ASTM) D-1160) | °F. | (°C.) |
| IBP | 338 | (170) |
| 10% | 516 | (269) |
| 20% | 628 | (331) |
| 30% | 690 | (367) |
| 40% | 730 | (388) |
| 50% | 750 | (399) |
| 60% | 800 | (421) |
| 70% | 831 | (444) |
| 80% | 882 | (474) |
| % Over | 80 | |
| % Bottoms | 20 | |
| Sulfur, weight percent | | 0.5 |
| Polychlorinated Biphenyl Concentration, wppm | | 20 |
| Lead, wppm | | 863 |
| Zinc, wppm | | 416 |
| Cadmium, wppm | | 1 |
| Copper, wppm | | 21 |
| Chromium, wppm | | 5 |

The waste lube oil is preheated to a temperature of <482° F. (<250° C.) before introduction into the hot hydrogen flash separation zone which temperature precludes any significant detectable thermal degradation. The waste lube oil is intimately contacted in the hot flash separation zone with a hot hydrogen-rich gaseous stream having a temperature upon introduction into the hot hydrogen flash separation zone of >748° F. (>398° C.). In addition, the hot hydrogen flash separation zone is operated at conditions which included a temperature of 788° F. (420° C.), a pressure of 810 psig (5585 kPa gauge), a hydrogen circulation rate of 18,000 SCFB (3034 normal $m^3/m^3$) based on the waste lube oil and an average residence time of the vapor stream of 5 seconds.

A hydrocarbonaceous vapor stream comprising hydrogen is recovered from the hot hydrogen flash separation zone, and is directly introduced without separation into a hydrogenation reaction zone containing a hydrogenation catalyst comprising alumina, nickel and molybdenum. Properties of the $C_7$+ fraction entering the reaction zone are presented in Table 2. The hydrogenation reaction is conducted with a catalyst peak temperature of 662° F. (350° C.), a pressure of 800 psig (5516 kPa gauge), a liquid hourly space velocity of 0.5 based on hydrocarbon feed to the hydrogenation reaction zone and a hydrogen to oil ratio of 20,000 SCFB (3370 normal $m^3/m^3$). The hydrogenated effluent from the hydrogenation reaction zone including small quantities of hydrogen chloride is passed into a hot flash zone to produce a heavy hydrocarbonaceous stream and a gaseous stream containing hydrogen, hydrogen chloride, hydrogen sulfide and lower molecular weight hydrocarbons which gaseous stream is contacted with an aqueous scrubbing solution containing sodium hydroxide, cooled to about 100° F. (38° C.), and sent to a vapor-liquid separator wherein a gaseous hydrogen-rich stream is separated from the normally liquid hydrocarbonaceous phase and spent aqueous scrubbing solution containing sodium, sulfide and chloride ions. The resulting gaseous hydrogen-rich stream is bifurcated to provide a first stream which is passed through an adsorption zone to remove any trace quantities of organic halide compounds and to provide a fuel gas stream, and a second stream which is compressed and admixed with a fresh supply of hydrogen in an amount sufficient to maintain the hydrogenation reaction zone pressures. The resulting normally liquid hydrocarbonaceous phase is introduced into a fluid catalytic cracking zone.

TABLE 2

| PROPERTIES OF $C_7^+$ FRACTION OF REACTION ZONE FEED | | |
|---|---|---|
| Specific Gravity @ 60° F. (15° C.) | | 0.866 |
| Vacuum Distillation Boiling Range, (ASTM D-1160) | °F. | (°C.) |
| IBP | 225 | (107) |
| 10% | 433 | (223) |
| 20% | 538 | (280) |
| 30% | 633 | (334) |
| 40% | 702 | (372) |
| 50% | 741 | (394) |
| 60% | 770 | (410) |
| 70% | 801 | (427) |
| 80% | 837 | (447) |
| 90% | 896 | (479) |
| 95% | 943 | (506) |
| EP | 982 | (527) |
| % Over | 97 | |
| % Bottoms | 3 | |
| Sulfur, weight percent | | 0.31 |
| Polychlorinated Biphenyl Concentration, wppm | | 22 |
| Lead, wppm | | 3.7 |
| Zinc, wppm | | 1.5 |
| Cadmium, wppm | | <0.04 |
| Copper, wppm | | 0.1 |
| Chromium, wppm | | 0.6 |

A non-distillable liquid stream containing asphalt is recovered from the bottom of the flash separation zone in an amount of 150 mass units per hour and having the characteristics presented in Table 3.

TABLE 3

| ANALYSIS OF NON-DISTILLABLE STREAM | |
|---|---|
| Specific Gravity @ 60° F. (15° C.) | 1.0 |
| Polychlorinated Biphenyl Concentration, wppm | <0.2 |

An atmospheric residue in an amount of 400 mass units per hour which was prepared from a whole crude oil and which atmospheric residue having the characteristics presented in Table 4 is introduced into a vacuum unit to produce 130 mass units per hour of vacuum gas oil and 270 mass units per hour of vacuum tower bottoms. A portion of this vacuum tower bottoms (asphalt residue) is introduced into the hot hydrogen flash separation zone as previously described.

The previously produced vacuum gas oil is introduced into a fluid catalytic cracking zone together with the normally liquid hydrocarbonaceous phase described hereinabove to produce 210 mass units per hour of product including 30 mass units of LPG, 120 mass units of 92 research octane number gasoline and 60 mass units of fuel oil.

From these results, it is readily apparent that the production of gasoline is significantly increased by charging waste lubricant and utilizing the integrated process of the present invention.

TABLE 4

| ATMOSPHERIC RESIDUE FEEDSTOCK PROPERTIES | |
|---|---|
| Specific Gravity @ 60° F. (15° C.) | 0.95 |
| Distillation, °C. | |
| IBP | 345 |
| 50% | 600 |
| EP | 600 |
| % Over | 50 |
| % Residue | 50 |

The foregoing description, drawing and illustrative embodiment clearly demonstrate the advantages encompassed by the process of the present invention and the benefits to be afforded with the use thereof.

What is claimed is:

1. An integrated process for the production of distillate hydrocarbon from atmospheric fractionation residue and waste lubricant which process comprises:

(a) fractionating said atmospheric fractionation residue in a vacuum fractionation zone to provide a first distillable hydrocarbon stream and a vacuum fractionation residue;

(b) contacting said waste lubricant and at least a fraction of said vacuum fractionation residue with a hot first hydrogen-rich gaseous stream in a flash zone at flash conditions thereby increasing the temperature of said waste lubricant to provide a hydrocarbonaceous vapor stream comprising hydrogen and a non-distillable component containing asphalt;

(c) contacting said hydrocarbonaceous vapor stream comprising hydrogen with a hydrogenation catalyst in a hydrogenation reaction zone at hydrogenation conditions to increase the hydrogen content of the hydrocarbonaceous compounds;

(d) condensing at least a portion of the resulting effluent from the hydrogenation reaction zone to provide a second hydrogen-rich gaseous stream and a liquid stream comprising hydrogenated distillable hydrocarbonaceous compounds;

(e) contacting at least a portion of said first distillable hydrocarbon stream recovered in step (a) and at least a fraction of said liquid stream comprising hydrogenated distillable hydrocarbonaceous compounds recovered in step (d) with a hydrocarbon conversion catalyst in a hydrocarbon conversion zone to produce lower molecular weight hydrocarbon compounds; and (f) recovering at least one distillate hydrocarbon product stream from the effluent from said hydrocarbon conversion zone.

2. The process of claim 1 wherein said waste lubricant comprises a component selected from the group consisting of hydraulic fluids, heat transfer fluids, used lubricating oil, used cutting oils and used solvents.

3. The process of claim 1 wherein said waste lubricant comprises a non-distillable component selected from the group consisting of organometallic compounds, inorganic metal compounds, finely divided particulate matter and non-distillable hydrocarbonaceous compounds.

4. The process of claim 1 wherein said waste lubricant is introduced into said flash zone at a temperature less than about 482° F. (250° C.).

5. The process of claim 1 wherein the temperature of said first hydrogen-rich gaseous stream is from about 200° F. (93° C.) to about 1200° F. (649° C.).

6. The process of claim 1 wherein said flash conditions include a temperature from about 150° F. (65° C.) to about 860° F. (460° C.), a pressure from about atmospheric to about 2000 psig (13,788 kPa gauge), a hydrogen circulation rate of about 1000 SCFB (168 normal $m^3/m^3$) to about 60,000 SCFB (10,110 normal $m^3/m^3$) based on said first feedstock, and an average residence time of said hydrocarbonaceous vapor stream comprising hydrogen in said flash zone from about 0.1 seconds to about 50 seconds.

7. The process of claim 1 wherein said hydrogenation reaction zone is operated at conditions which include a pressure from about atmospheric (0 kPa gauge) to about 2000 psig (13790 kPa gauge), a maximum catalyst temperature from about 122° F. (50° C.) to about 850° F. (454° C.) and a hydrogen circulation rate from about 200 SCFB (33.7 normal $m^3/m^3$) to about 70,000 SCFB (11,796 normal $m^3/m^3$).

8. The process of claim 1 wherein said hydrogenation catalyst comprises a refractory inorganic oxide and at least one metallic compound having hydrogenation activity.

9. The process of claim 8 wherein said metallic compound is selected from the metals of Group VIB and VIII of the Periodic Table.

10. The process of claim 1 wherein at least a portion of the resulting effluent from said hydrogenation zone is contacted with an aqueous scrubbing solution.

11. The process of claim 10 wherein said aqueous scrubbing solution comprises a compound selected from the group consisting of calcium hydroxide, potassium hydroxide, potassium carbonate, sodium carbonate and sodium hydroxide.

12. The process of claim 1 wherein said hydrocarbon conversion zone of step (e) is selected from the group consisting of a fluid catalytic cracking unit and a hydrocracking unit.

13. The process of claim 1 wherein said fraction of said vacuum fractionation residue is prepared by solvent deasphalting said vacuum fractionation residue.

14. An integrated process for the production of distillate hydrocarbon from atmospheric fraction residue and waste lubricant which process comprises:

(a) fractionating said atmospheric fraction residue in a vacuum fractionation zone to provide a first distillable hydrocarbon stream and a vacuum fractionation residue;

(b) contacting said waste lubricant and at least a fraction of said vacuum fractionation residue in an amount from about 1 to about 150 volume percent of said waste lubricant with a hot first hydrogen-rich gaseous stream in a flash zone at flash conditions thereby increasing the temperature of said waste lubricant to provide a hydrocarbonaceous vapor stream comprising hydrogen and a non-distillable component containing asphalt;

(c) contacting said hydrocarbonaceous vapor stream comprising hydrogen with a hydrogenation catalyst in a hydrogenation reaction zone at hydrogenation conditions to increase the hydrogen content of the hydrocarbonaceous compounds;

(d) condensing at least a portion of the resulting effluent from the hydrogenation reaction zone to provide a second hydrogen-rich gaseous stream and a liquid stream comprising hydrogenated distillable hydrocarbonaceous compounds;

(e) contacting at least a portion of said first distillable hydrocarbon stream recovered in step (a) and at least a fraction of said liquid stream comprising hydrogenated distillable hydrocarbonaceous compounds recovered in step (d) with a hydrocarbon conversion catalyst in a hydrocarbon conversion zone to produce lower molecular weight hydrocarbon compounds;

(f) recovering at least one distillate hydrocarbon product stream from the effluent from said hydrocarbon conversion zone; and (g) recovering at least a portion of said vacuum fractionation residue and said non-distillable component containing asphalt.

* * * * *